US006935902B1

(12) United States Patent
Chou

(10) Patent No.: US 6,935,902 B1
(45) Date of Patent: Aug. 30, 2005

(54) COUPLER DEVICE FOR POWER SUPPLY FACILITY

(76) Inventor: Ching Lin Chou, P.O.Box 63-99, Taichung (TW) 406

( * ) Notice: Subject to any disclaimer, the term of this patent is extended or adjusted under 35 U.S.C. 154(b) by 0 days.

(21) Appl. No.: 10/911,352

(22) Filed: Aug. 5, 2004

(51) Int. Cl.[7] ..... H01R 13/502
(52) U.S. Cl. ..... 439/701; 439/717
(58) Field of Search ..... 439/701, 717, 439/594, 502; 174/72 A, 71 R; 361/683; 29/861

(56) References Cited

U.S. PATENT DOCUMENTS

| | | | | | |
|---|---|---|---|---|---|
| 2,871,457 | A * | 1/1959 | Jencks et al. | 439/370 |
| 3,848,951 | A * | 11/1974 | Michaels et al. | 439/357 |
| 4,674,819 | A * | 6/1987 | Fujitani et al. | 439/404 |
| 4,780,090 | A * | 10/1988 | Sugiyama et al. | 439/247 |
| 4,790,763 | A * | 12/1988 | Weber et al. | 439/65 |
| 4,797,123 | A * | 1/1989 | Weber | 439/717 |
| 4,820,169 | A * | 4/1989 | Weber et al. | 439/65 |
| 4,922,125 | A * | 5/1990 | Casanova et al. | 307/149 |
| 4,973,859 | A * | 11/1990 | Shodai | 307/10.1 |
| 5,427,549 | A * | 6/1995 | Smith et al. | 439/701 |
| 5,487,677 | A * | 1/1996 | Hoffner | 439/293 |
| 5,569,047 | A * | 10/1996 | Pauza et al. | 439/353 |
| 5,643,015 | A * | 7/1997 | Wakata | 439/701 |
| 5,790,372 | A * | 8/1998 | Dewey et al. | 361/683 |
| 5,855,064 | A * | 1/1999 | Chang | 29/861 |
| 5,904,598 | A * | 5/1999 | Yamanashi | 439/701 |
| 5,941,720 | A * | 8/1999 | Byrne | 439/215 |
| 6,030,247 | A * | 2/2000 | Sasahara | 439/332 |
| 6,059,615 | A * | 5/2000 | Pendleton et al. | 439/717 |
| 6,113,415 | A * | 9/2000 | Bertsch et al. | 439/353 |
| 6,129,598 | A * | 10/2000 | Yu et al. | 439/883 |
| 6,193,550 | B1 * | 2/2001 | Yamashita et al. | 439/594 |
| 6,314,001 | B1 * | 11/2001 | Chu | 361/826 |
| 6,332,813 | B1 * | 12/2001 | Okabe et al. | 439/701 |
| 6,354,887 | B2 * | 3/2002 | Maeda | 439/701 |
| 6,375,517 | B1 * | 4/2002 | Okabe et al. | 439/701 |
| 6,503,098 | B2 * | 1/2003 | Aoki et al. | 439/502 |
| 6,520,810 | B1 * | 2/2003 | LePottier et al. | 439/701 |
| 6,621,688 | B1 * | 9/2003 | Burdick | 361/627 |
| 6,729,897 | B2 * | 5/2004 | Lai | 439/347 |
| 6,731,507 | B2 * | 5/2004 | Varghese et al. | 361/725 |
| 6,736,658 | B2 * | 5/2004 | Milan | 439/189 |

OTHER PUBLICATIONS

Picture of Instrumental Panel Harness for Toyota Echo made by Sumitomo Wiring System, presented on May 2003.*

* cited by examiner

*Primary Examiner*—Ross Gushi
*Assistant Examiner*—Larisa Tsukerman
(74) *Attorney, Agent, or Firm*—Birch, Stewart, Kolasch & Birch, LLP

(57) ABSTRACT

A power supply facility includes a housing, a coupler device coupled to the housing with a cable, and having a number of prongs, another coupler device coupled to the housing with a cable and having a number of prongs, and a connecting device for selectively connecting the coupler devices together. For example, the connecting device includes dovetails or dovetail slots disposed on the coupler devices for connecting the coupler devices together. The two coupler devices include different numbers of prongs for plugging to computer facilities having different socket openings.

14 Claims, 7 Drawing Sheets

COUPLER DEVICE FOR POWER SUPPLY FACILITY

BACKGROUND OF THE INVENTION

1. Field of the Invention

The present invention relates to a coupler device for power supply facility, and more particularly to a coupler device having changeable prongs for coupling the power supply facility to various computer facilities and/or power suppliers.

2. Description of the Prior Art

Typical power supply facilities may comprise one or more coupler devices for coupling to various computer facilities and/or power suppliers or the like.

For example, as shown in FIG. 1, illustrated is one of the typical power supply facilities 10 comprising two different coupler devices 11, 13 for coupling to various computer facilities and/or power suppliers or the like. One of the coupler devices 11 includes twenty (20) prongs 12 provided thereon, for example, and the other coupler device 12 includes four (4) prongs 14 provided thereon, for example, for coupling to socket openings of one kind of the computer facilities and/or power suppliers or the like.

However, for the other computer facilities and/or power suppliers or the like, they may include different numbers of socket openings formed therein, such that the coupler devices 11, 13 of the typical power supply facilities 10 may not be coupled to different computer facilities and/or power suppliers or the like.

As shown in FIG. 2, illustrated is the other typical power supply facility 10 comprising two different coupler devices 15, 17 for coupling to various computer facilities and/or power suppliers or the like. One of the coupler devices 15 includes twenty four (24) prongs 16 provided thereon, for example, and the other coupler device 17 includes eight (8) prongs 18 provided thereon, for example, for coupling to socket openings of the other kind of the computer facilities and/or power suppliers or the like.

For coupling to the two different kinds of computer facilities and/or power suppliers or the like, the users may have to purchase two of the typical power supply facilities 10 that have different coupler devices 11, 13; and 15, 17 of different numbers of prongs for coupling to various computer facilities and/or power suppliers or the like.

The present invention has arisen to mitigate and/or obviate the afore-described disadvantages of the conventional coupler device for power supply facilities.

SUMMARY OF THE INVENTION

The primary objective of the present invention is to provide a coupler device for power supply facility including selective or changeable prongs for coupling to various computer facilities and/or power suppliers or the like.

In accordance with one aspect of the invention, there is provided a power supply facility comprising a housing, a first coupler device coupled to the housing with a cable, and including a plurality of prongs provided thereon, a second coupler device coupled to the housing with a cable, and including a plurality of prongs provided thereon, and a connecting device for selectively connecting the first and the second coupler devices together.

The connecting device includes a first connecting device provided on the first coupler device, and a second connecting device provided on the second coupler device and connectable with the first coupler device, to selectively connect the first and the second coupler devices together.

The first coupler device includes twenty prongs provided thereon, and the second coupler device includes four prongs provided thereon; or the first coupler device may include four prongs provided thereon, and the second coupler device may include four prongs provided thereon.

A third coupler device may further be provided and coupled to the housing with a cable, and including a plurality of prongs provided thereon. A fourth coupler device may further be provided and coupled to the housing with a cable, and includes a plurality of prongs provided thereon. A connecting device may further be provided for selectively connecting the third and the fourth coupler devices together.

The connecting device includes a third connecting device provided on the third coupler device, and a fourth connecting device provided on the fourth coupler device and connectable with the third coupler device, to selectively connect the third and the fourth coupler devices together.

The third coupler device may include twenty prongs provided thereon, and the fourth coupler device may include four prongs provided thereon; or the third coupler device may include four prongs provided thereon, and the fourth coupler device may include four prongs provided thereon.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 5 is a partial exploded view illustrating the coupling of one of the coupler devices to sockets of computer facilities and/or power suppliers or the like;

FIG. 6 is a partial exploded view illustrating the coupling of another coupler device to sockets of computer facilities and/or power suppliers or the like; and FIGS. 7 and 8 are partial exploded views similar to FIGS. 5 and 6 respectively, illustrating the coupling of the coupler devices having changeable prongs to different sockets of computer facilities and/or power suppliers or the like.

DETAILED DESCRIPTION OF THE PREFERRED EMBODIMENT

Figure 1:
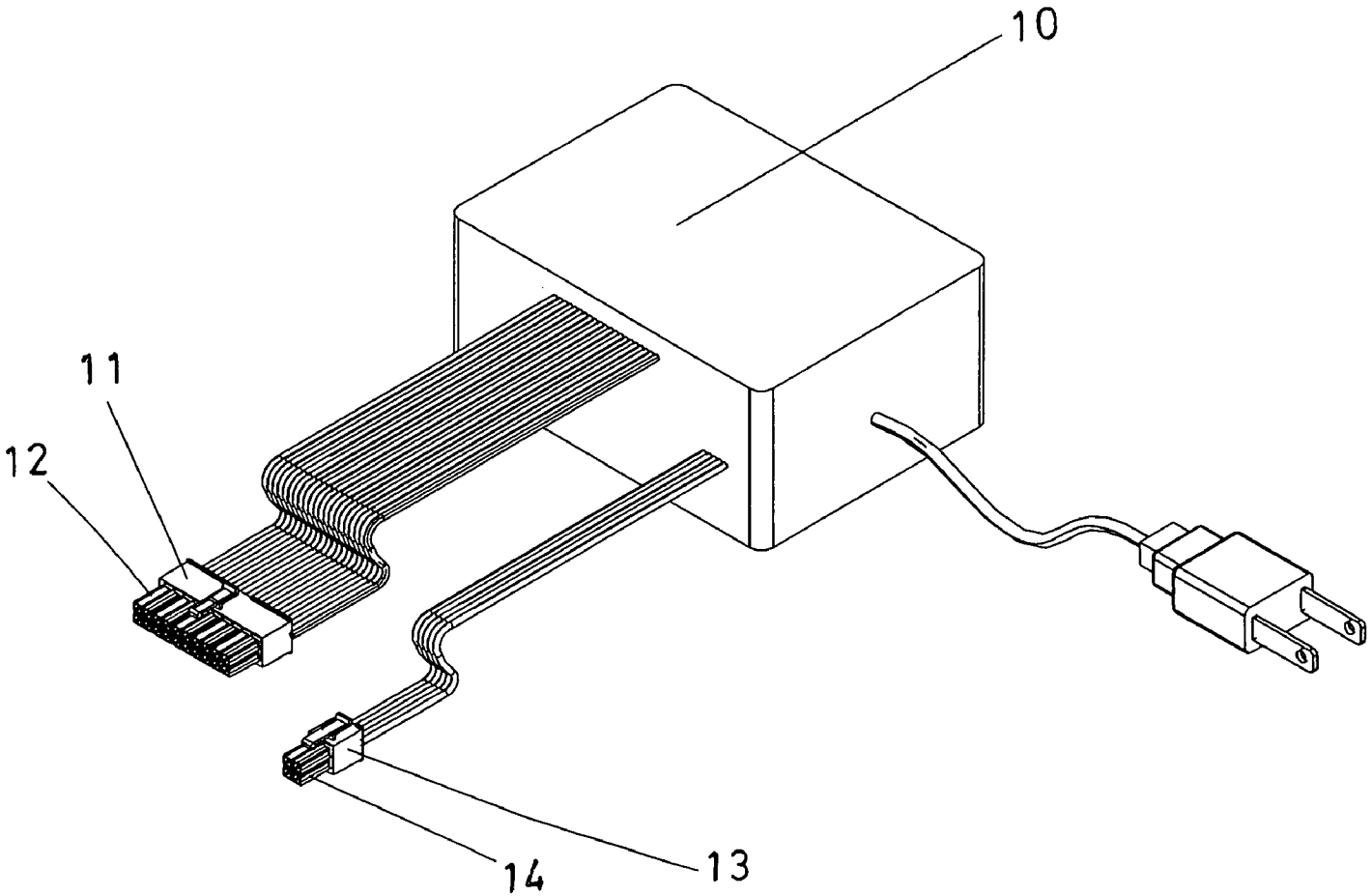
FIG. 1 PRIOR ART
FIG. 1 is a perspective view illustrating one of the typical coupler devices for power supply facilities.
Figure 2:
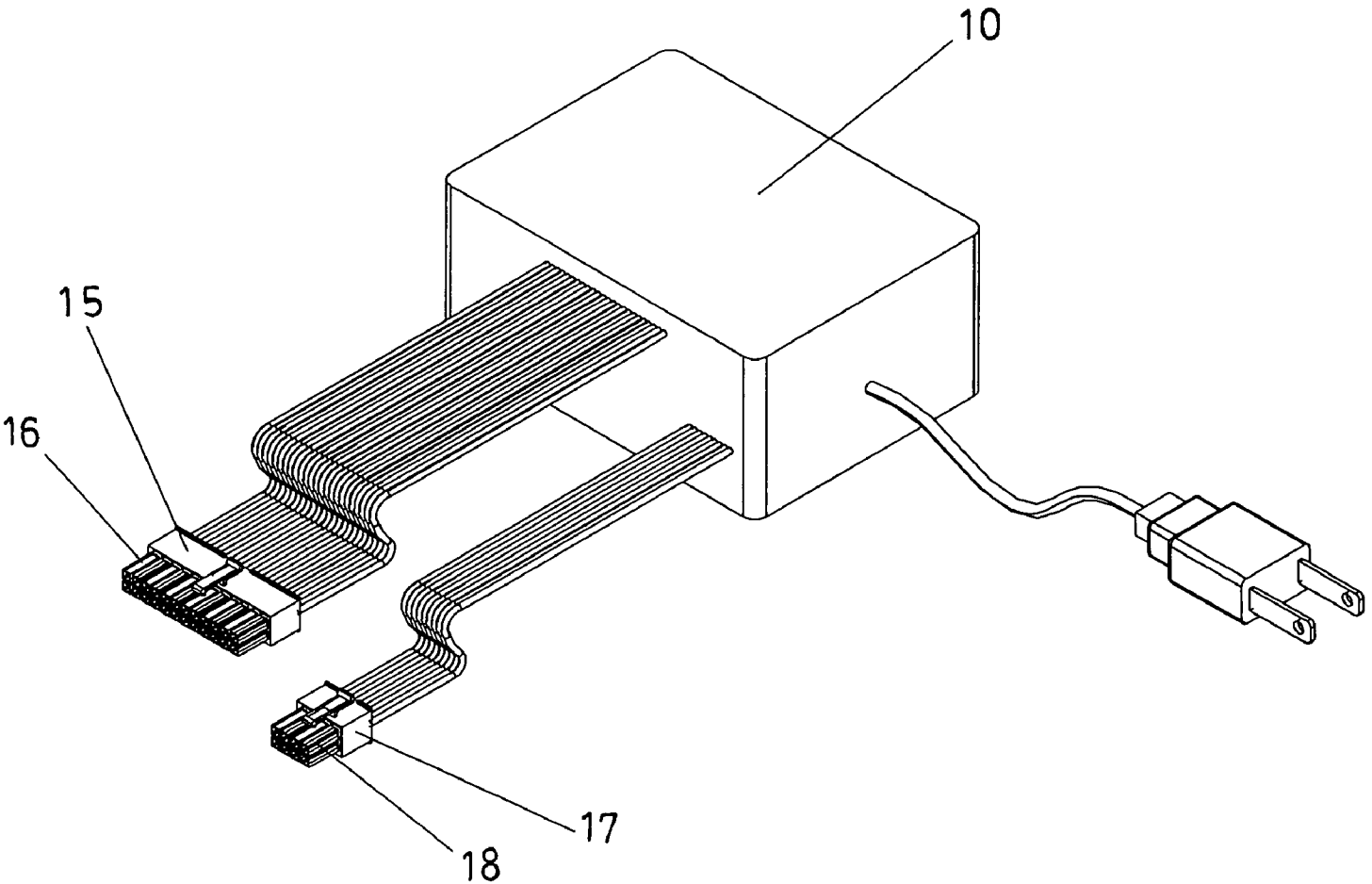
FIG. 2 PRIOR ART
FIG. 2 is a perspective view illustrating the other typical coupler device for power supply facilities.
Figure 3:
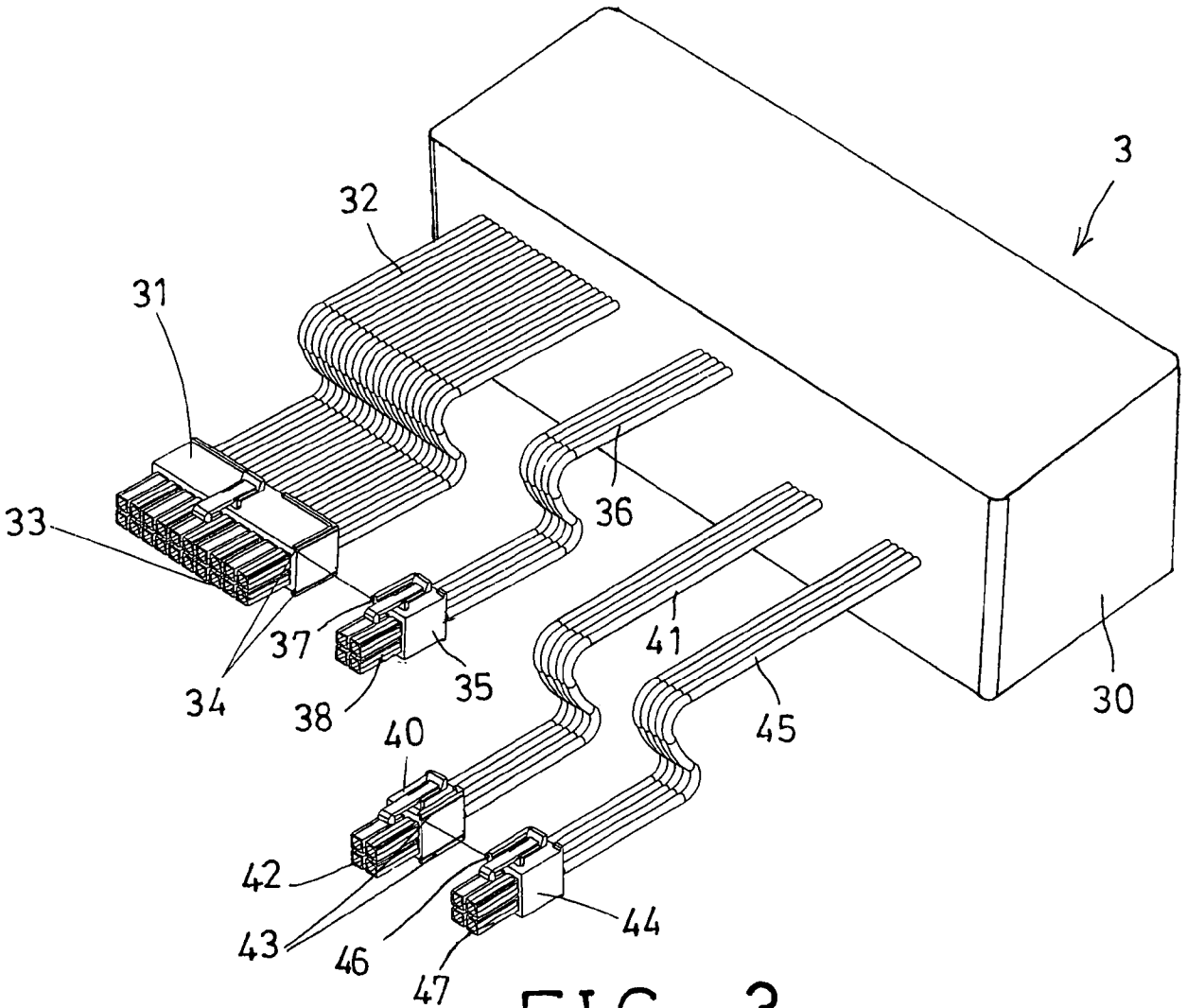
FIG. 3 is a perspective view of a power supply facility having coupler devices of changeable prongs in accordance with the present invention.
Figure 4:
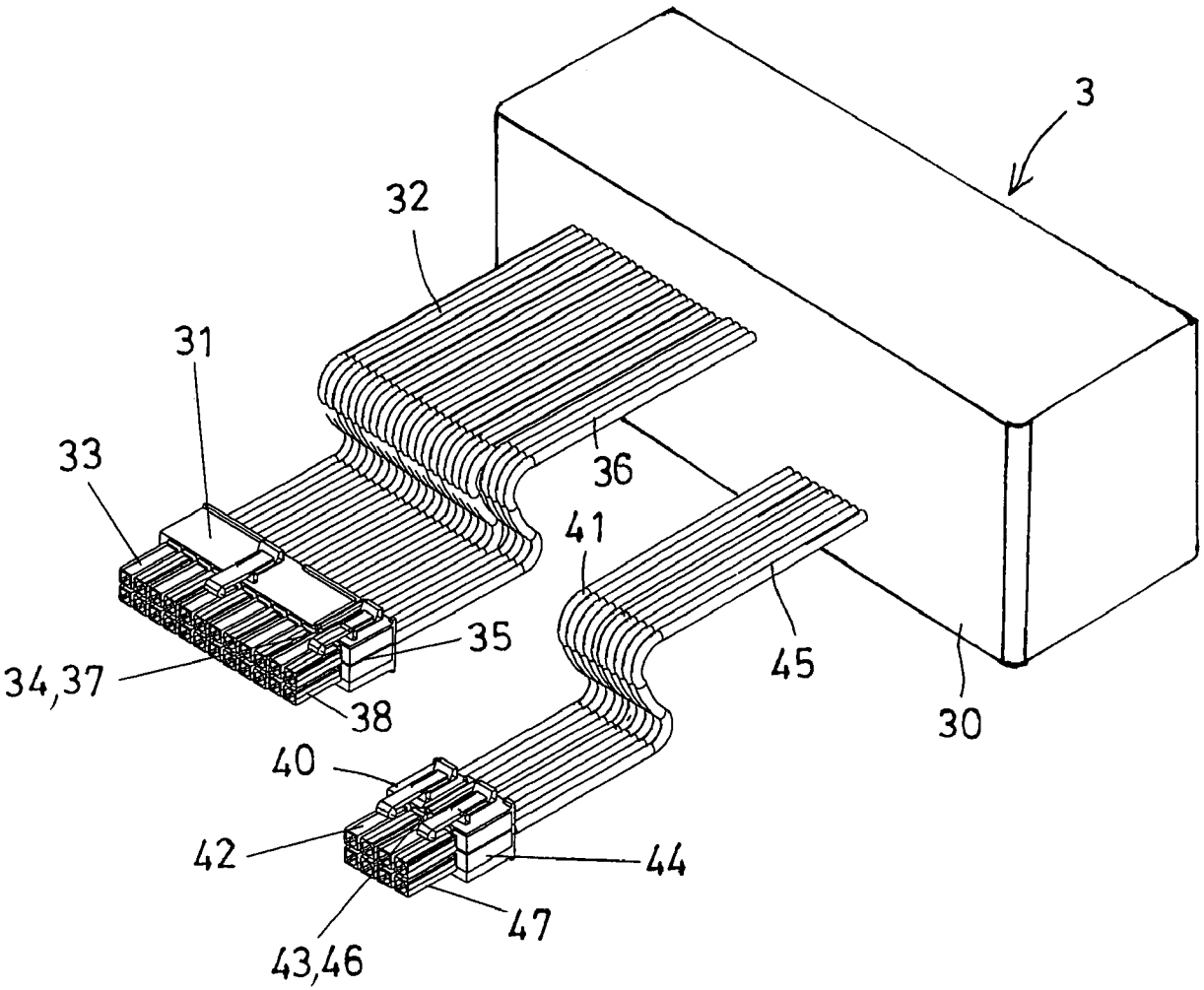
FIG. 4 is a perspective view similar to FIG. 3, illustrating the operation of the coupler devices of the power supply facility.

Referring to the drawings, and initially to FIG. 3, a power supply facility 3 in accordance with the present invention comprises a housing 30, a coupler device 31 coupled to the housing 30 with a cable 32 and including a number of prongs 33, such as twenty (20) prongs 33 provided thereon, and the coupler device 31 includes a connecting device 34, such as a dovetail or a dovetail slot 34 formed therein.

The housing 30 further includes another coupler device 35 coupled to the housing 30 with a cable 36, and includes a connecting device 37, such as a dovetail slot or a dovetail 37 formed or provided therein, for connecting to the corresponding dovetail or dovetail slot 34 of the coupler device 31, and for selectively attaching or securing the coupler devices 31, 35 together. The coupler device 35 includes a number of prongs 38, such as four (4) prongs 38 provided thereon. The coupler devices 31, 35 that are connected or secured together may thus have twenty four (24) prongs 33, 38 provided thereon.

The housing 30 further includes a further coupler device 40 coupled to the housing 30 with a cable 41, and includes a number of prongs 42, such as four (4) prongs 42 provided thereon, and the coupler device 40 includes a connecting device 43, such as a dovetail or a dovetail slot 43 formed therein.

The housing 30 further includes a still further coupler device 44 coupled to the housing 30 with a cable 45, and includes a connecting device 46, such as a dovetail slot or a dovetail 46 formed or provided therein, for connecting to the corresponding dovetail or dovetail slot 43 of the coupler device 40, and for selectively attaching or securing the coupler devices 40, 44 together. The coupler device 44 includes a number of prongs 47, such as four (4) prongs 47 provided thereon. The coupler devices 40, 44 that are connected or secured together may thus have eight (8) prongs 42, 47 provided thereon.

Figure 6:
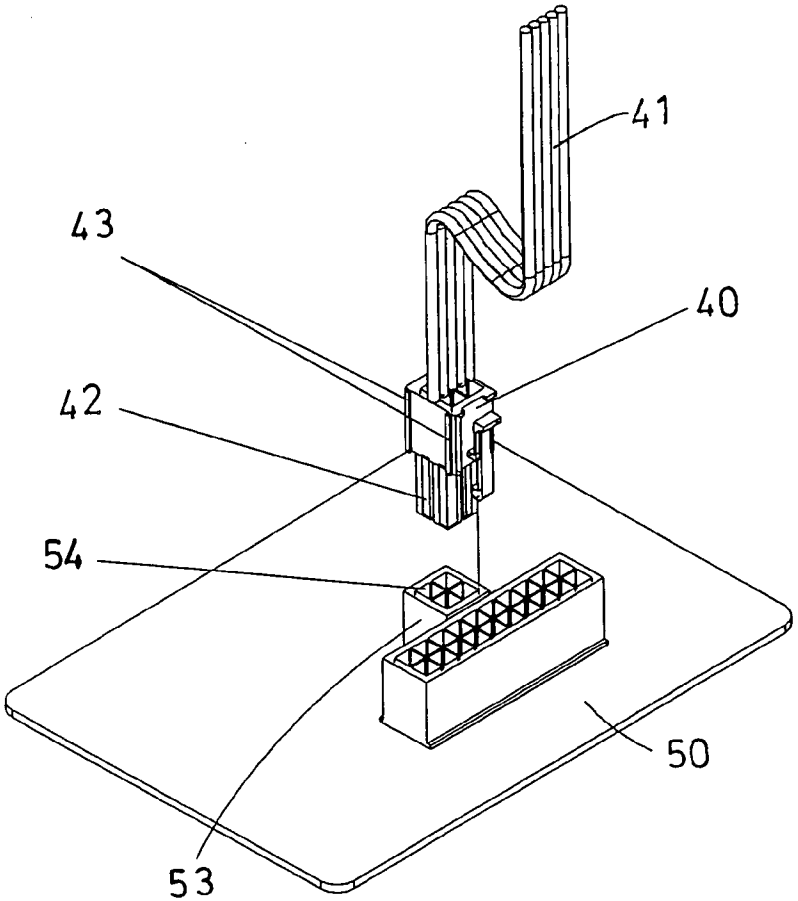
Figure 5:
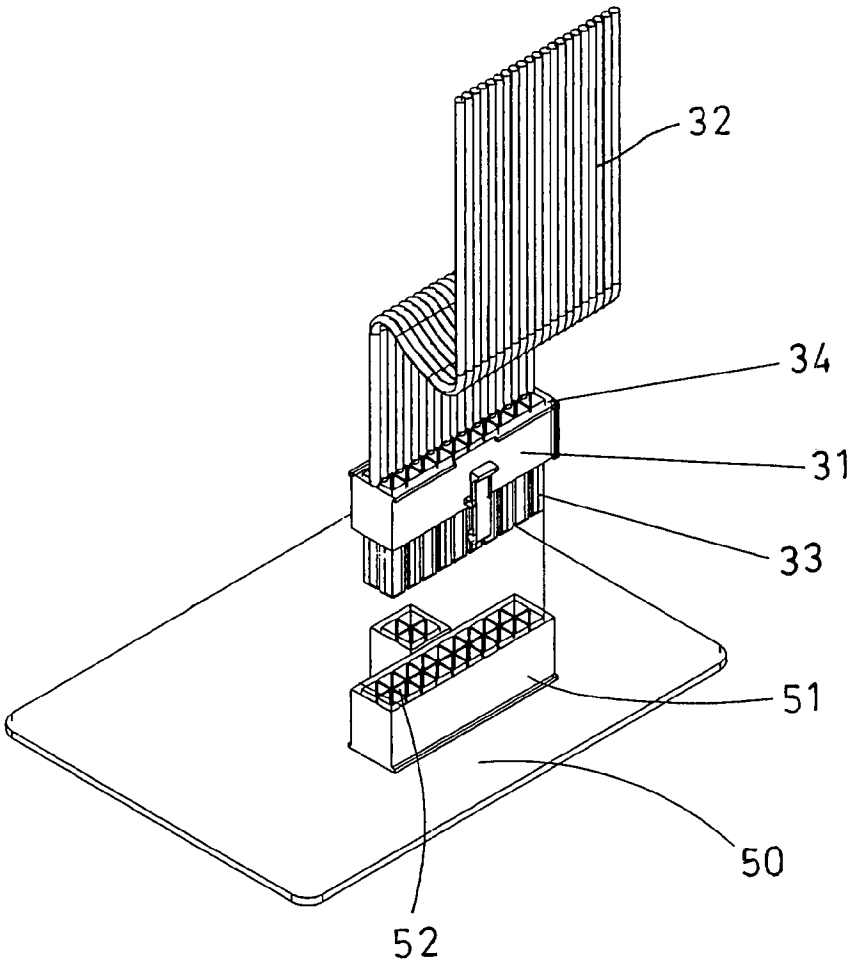

In operation, as shown in FIGS. 5 and 6, when the power supplier or the computer facility 50 includes two sockets 51, 53 having twenty (20) and four (4) socket openings 52, 54 formed therein respectively, the coupler devices 31, 40 that have twenty (20) and four (4) prongs 33, 42 provided thereon may be plugged to the socket openings 52, 54 of the sockets 51, 53 respectively.

Figure 7:
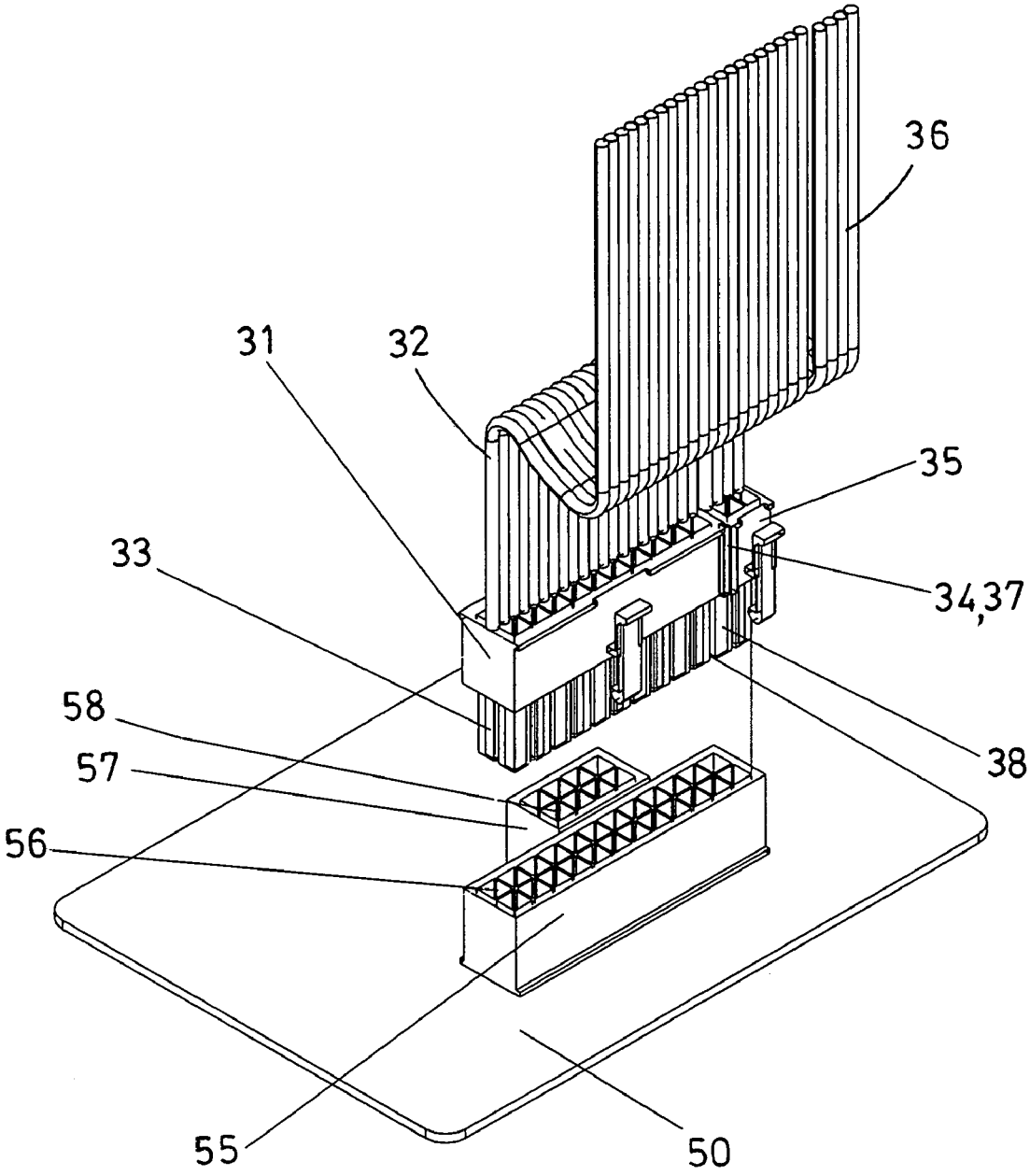
Figure 8:
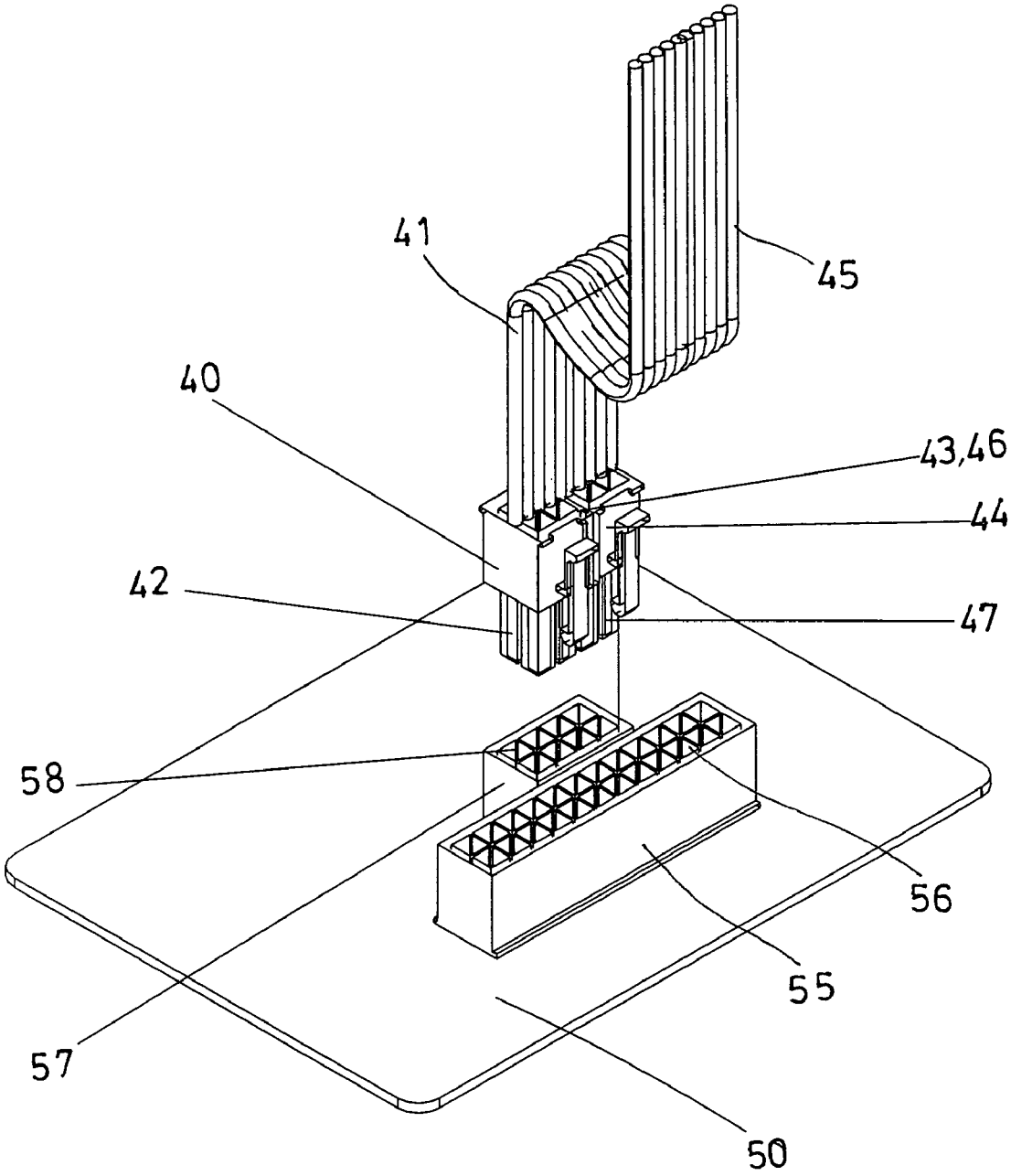

As shown in FIGS. 7 and 8, when the power supplier or the computer facility 50 includes two sockets 55, 57 having twenty four (24) and eight (8) socket openings 56, 58 formed therein respectively, the coupler devices 31, 35; and 40, 44 may be selectively connected together and may have twenty four (24) and eight (8) prongs 33, 38; and 42, 47 provided thereon respectively, for plugging to the socket openings 56, 58 of the sockets 55, 57 respectively.

Accordingly, the coupler device for power supply facility in accordance with the present invention includes selective or changeable prongs for coupling to various computer facilities and/or power suppliers or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A power supply facility comprising:

a housings;

a first coupler device coupled to said housing with a first cable, and including a plurality of prongs provided thereon;

a second coupler device coupled to said housing with a second cable, and including a plurality of prongs provided thereon;

a first connecting device provided on a left side of said first coupler device; and a second connecting device provided on a right side of said second coupler device, said second connecting device being connectable with said first connecting device to selectively secure said first and said second coupler devices together, thereby power being provided to a single device via a combination of said first cable and said second cable.

2. The power supply facility as claimed in claim 1, wherein said first coupler device includes twenty prongs provided thereon, and said second coupler device includes four prongs provided thereon.

3. The power supply facility as claimed in claim 1, wherein said first coupler device includes four prongs provided thereon, and said second coupler device includes four prongs provided thereon.

4. The power supply facility as claimed in claim 1 further comprising a third coupler device coupled to said housing with a third cable, and including a plurality of prongs provided thereon.

5. The power supply facility as claimed in claim 4 further comprising a fourth coupler device coupler to said housing with a fourth cable, and including a plurality of prongs provided thereon.

6. The power supply facility as claimed in claim 5 further comprising means for selectively connecting said third and said fourth coupler devices together.

7. The power supply facility as claimed in claim 5, wherein said third coupler device includes twenty prongs provided thereon, and said fourth coupler device includes four prongs provided thereon.

8. The power supply facility as claimed in claim 5, wherein said third coupler device four prongs provided thereon, and said fourth coupler device includes four prongs provided thereon.

9. The power supply facility as claimed in claim 6, wherein said connecting means includes a third connecting device provided on said third coupler device, and a fourth connecting device provided on said fourth coupler device and connectable with said third coupler device, to selectively connect said third and said fourth coupler devices together.

10. The power supply facility as claimed in claim 1, said first connecting device entirely occupies said left side of said first coupler device, and said second connecting device entirely occupies said right side of said second coupler device.

11. The power supply facility as claimed in claim 10, said left side of said first coupler device entirely contacts said right side of said second coupler device when said first and said second coupler devices are selectively secured.

12. The power supply facility as claimed in claim 11, a spacing between all of the plurality of prongs is uniform when said first and said second coupler devices are selectively secured.

13. The power supply facility as claimed in claim 1, said left side of said first coupler device entirely contacts said right side of said second coupler device when said first and said second coupler devices are selectively secured.

14. The power supply facility as claimed in claim 1, a spacing between all of the plurality of prongs is uniform when said first and said second coupler devices are selectively secured.

* * * * *